United States Patent [19]

Arndt

[11] Patent Number: 4,527,510

[45] Date of Patent: Jul. 9, 1985

[54] APPARATUS FOR APPLYING A COATING TO A MOVING SURFACE

[75] Inventor: Raymond J. Arndt, Chicago, Ill.

[73] Assignee: Mactron, Inc., Worth, Ill.

[21] Appl. No.: 494,516

[22] Filed: May 13, 1983

[51] Int. Cl.[3] ..... B05B 12/04; B05C 5/00

[52] U.S. Cl. ..... 118/669; 118/682; 118/684; 118/324

[58] Field of Search ..... 118/669, 682, 684, 685, 118/324, 703

[56] References Cited

U.S. PATENT DOCUMENTS

| | | | |
|---|---|---|---|
| 3,177,846 | 4/1965 | Archer et al. | 118/25 |
| 3,496,907 | 2/1970 | Morison | 118/682 |
| 4,164,001 | 8/1979 | Patnaude | 361/236 |
| 4,389,971 | 6/1983 | Schmidt | 118/682 X |
| 4,408,562 | 10/1983 | Decamp et al. | 118/324 X |

OTHER PUBLICATIONS

Nordson, Timer Training Manual, 1975.

*Primary Examiner*—John P. McIntosh

*Attorney, Agent, or Firm*—Trexler, Bushnell & Wolters, Ltd.

[57] ABSTRACT

An improvement in apparatus for applying a coating to a surface of a moving workpiece including a coating dispenser having at least one coating outlet for dispensing a stream of coating. A dispenser control unit is operatively coupled with the dispenser for normally initiating and terminating the dispensing of the stream of coating as predetermined parts of the workpiece surface come into alignment with the coating outlet in response to the speed and position of the workpiece surface. The invention provides a minimum coating control coacting with the dispenser control unit for depositing a coating of a selectable minimum length to at least one portion of the workpiece surface, said selectable minimum length being substantially less than that achievable by said dispenser control unit alone.

8 Claims, 6 Drawing Figures

MINIMUM
200
TO
108
NORMAL
FROM 92
112
204
202
FROM 90
+V
140
144
160
158
162
164
174
166
138
136
134
130
132
117
VAC
142
156
154
150
152
151
GLU
146
196
189
184
182
170
172
186
193
190
192
194

APPARATUS FOR APPLYING A COATING TO A MOVING SURFACE

BACKGROUND OF THE INVENTION

The present invention is directed generally to the coating arts and more particularly to an improvement in a coating apparatus for applying a coating of a shorter length than may normally be reliably achieved with such apparatus.

While the invention may find utility in other applications, the disclosure will be facilitated by reference to the application of a liquid glue medium to a moving substrate such as a paper carton, in a desired pattern. In the manufacture of folding paper cartons and the like it is desirable to apply lines or beads of glue to predetermined surfaces of the folded carton and in predetermined patterns for use in later erecting and assembling the carton. In some cases very short lengths of glue beads are required, either as part of a pattern or on relatively short surfaces.

Heretofore, primarily contact methods of gluing have been used in this application. In one contact method, a glue applicator in the form of a roller or like apparatus contacts the surface of each carton as a plurality of cartons move down a conveyor. However, this method of glue application has a number of drawbacks, for example it is messy and difficult to control.

In many instances, the limitations of the gluing wheel may be circumvented by replacing it with a controllable extruding applicator which rides upon the surface of the substrate and is maintained in contact with the substrate by a spring loading arrangement. Most often, this applicator is pneumatically operated with the pneumatic system being controlled in turn by an electrically actuated pilot valve. By driving the pilot valve from an appropriate electronic controller, it is possible to lay down a desired glue pattern. Such systems have been employed successfully in many applications, most notably the gluing of corrugated cartons. However, their usefulness at high surface speeds is limited by the relatively slow response of the electropneumatic components as well as by the dynamics of the suspension which maintains the contact between the applicator and the substrate. Moreover, this approach is not suitable for use with more delicate media, such as small folding cartons, which are normally run at higher speeds and which are unable to sustain the forces imposed by the spring-loaded applicator. In such situations, attempts to employ a surface-riding applicator are likely to result in damage to the cartons and/or frequent jamming of the cartons in the transport.

As a solution to the foregoing problems, non-contact gluing systems have been offered. In such systems, a nozzle-type applicator is generally spaced some distance above the surfaces of the cartons on the conveyor for applying glue in the desired pattern. However, problems have also arisen with the non-contact system. For example, some delay is inherent between the release of glue from the nozzle and its impingement upon the surface of the carton. Hence, proper timing of the opening and closing of a valve feeding the dispensing nozzle is required to compensate for this delay and ensure the proper disposition of the desired pattern upon the carton surface. As the speed of the conveyor increases, this compensation becomes increasingly important. One solution to the delay compensation problem is set forth in the copending application of James E. DeCamp, et al., Ser. No. 332,947, filed Dec. 21, 1981, now U.S. Pat. No. 4,408,562, for apparatus for applying a coating to a moving surface. Briefly, the non-contact coating system disclosed in that copending application utilizes a position sensor to ascertain the position of a moving substrate such as a carton to which a coating such as glue is to be applied in a desired pattern.

Preferably, the position sensor comprises a moving member, such as a wheel which is in contact with, and hence rotated by, a conveyor carrying the workpiece or carton. This wheel is coupled to a suitable electrical circuit which develops a known number of output pulse signals for a given distance travelled by the conveyor and hence workpiece or carton. The dispensing of a coating such as glue in a predetermined pattern, including necessary delay compensation, is controlled in accordance with the output pulses developed by this circuit responsive to the position sensor. Hence, both the control of the desired pattern and the required delay compensation are independent of the speed of the conveyor and workpieces or cartons carried thereupon.

It has been found that with the foregoing non-contact coating system, that there is a finite limit to the minimum length of a line or pattern of a coating or glue bead which may be reliably and consistently applied. Moreover, this minimum increases with increasing speed of the conveyor. This occurs primarily due to the characteristics of the glue control valve which must be fully opened and then fully closed to reliably deliver a consistent glue bead. Hence, the minimum length glue bead which may be deposited is dependent upon the minimum time in which a given valve will reliably cycle through a close-open-close sequence and this time varies somewhat with the characteristics of individual valves. Accordingly, the minimum length glue bead which may be consistently deposited is dependent upon the foregoing factors as well as upon the speed of the conveyor in such a system. An additional problem is presented by standard error or deviation inherent in such a system, that is, an error of plus or minus one distance unit which may occur in a counting arrangement coupled with the distance or position sensor. In practice, it has been found that the minimum length coating or glue bead which may be deposited is on the order of between substantially 1 inch and 1.4 inches at 1,000 feet per minute conveyor speed and is directly proportionate to conveyor speed. Attempts to set in a shorter length result in less than the required minimum time for valve operation described above and unreliable operation.

While the speed independent system of non-contact coating has proven accurate and reliable in most applications, in some cases it is still desirable to deposit a coating or glue bead of lesser length than the minimum length possible with the system as described above.

OBJECTS AND SUMMARY OF THE INVENTION

It is a general object of the invention to provide a novel and improved apparatus for applying a coating to a moving surface which substantially avoids the problems of the prior art.

A more specific object is to provide a non-contact gluing apparatus for reliably applying glue in a desired pattern, including relatively short beads, to a moving surface.

A further object is to provide an apparatus in accordance with the foregoing objects which is capable of reliably applying significantly shorter glue beads than the prior art apparatus discussed above.

A related object is to provide an apparatus in accordance with the foregoing objects which may be readily added to an existing non-contact gluing apparatus without requiring substantial modification thereto.

Yet another object is to provide apparatus according to the foregoing objects which is relatively simple and inexpensive in its design and manufacture and yet highly reliable in operation.

Briefly and in accordance with the foregoing objects, the invention provides apparatus for applying a coating to a surface of a moving workpiece comprising coating dispensing means having at least one coating outlet spaced apart from said surface for dispensing a stream of coating, dispensing control means operatively coupled with said dispensing means for normally initiating and terminating the dispensing of said stream of coating as predetermined parts of said workpiece surface come into alignment with said coating outlet responsive to the position of said workpiece surface and means coacting with said dispensing control means for depositing a coating of predetermined minimum length to at least one portion of said workpiece surface, said predetermined minimum length being substantially less than the minimum length of coating achievable by said dispensing control means alone.

BRIEF DESCRIPTION OF THE DRAWINGS

The foregoing, as well as other objects, features and advantages of the invention will be more readily appreciated upon reading the following detailed description of the illustrated embodiment, together with reference to the drawings, wherein.

DETAILED DESCRIPTION OF THE ILLUSTRATED EMBODIMENT

Figure 1:
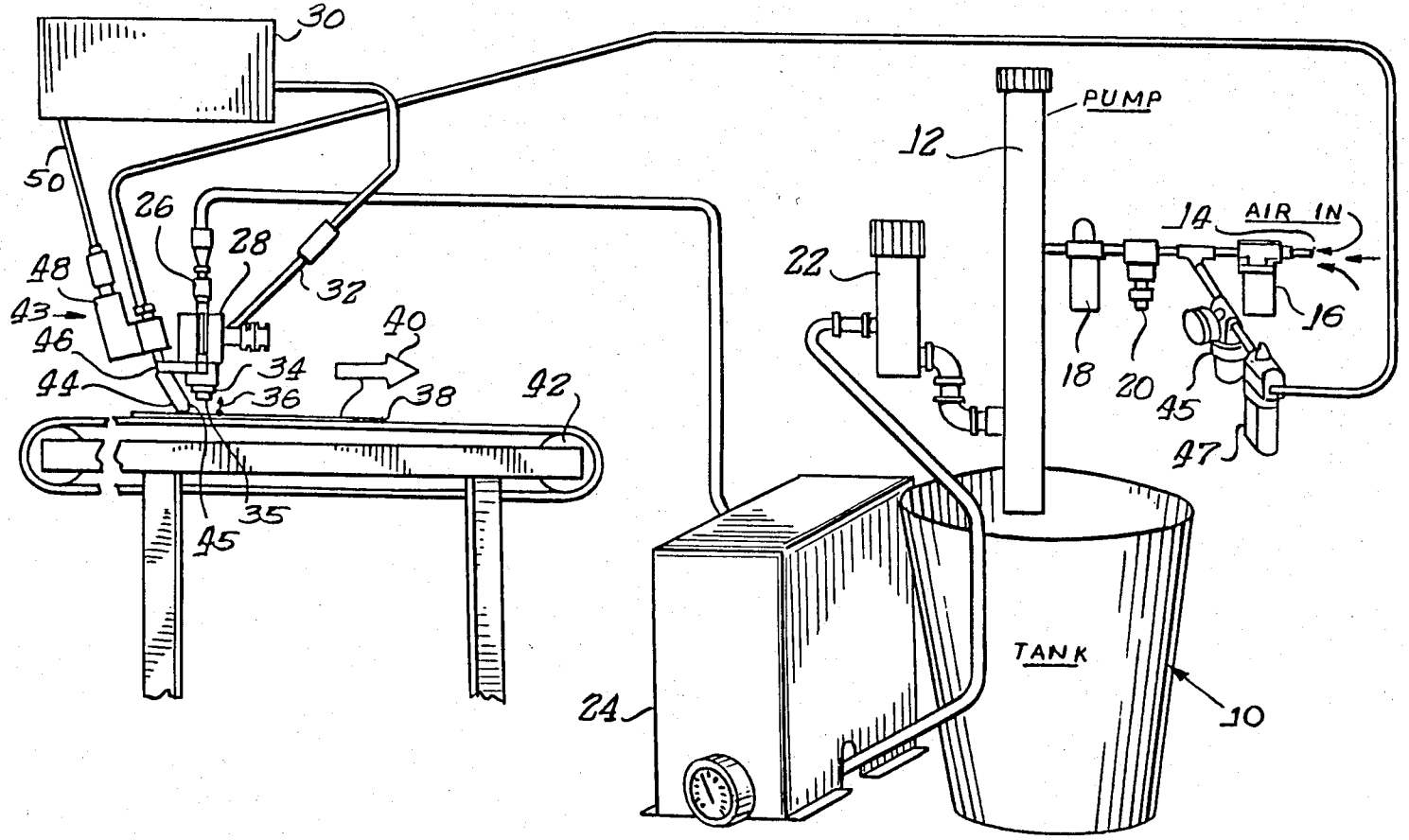
FIG. 1 is a side elevation, partially diagrammatic in form, illustrating apparatus with which the improvement of the invention may be advantageously utilized.

Referring to the drawings and initially to FIG. 1, there is seen a non-contact glue dispensing system. In accordance with conventional practice, the system includes a tank or reservoir 10 holding a supply of glue or other coating to be applied. The glue or other coating material from the tank 10 is fed out by way of a conventional pump 12 preferably powered by pressurized air admitted at an inlet 14. Conventional components including a filter 16, a lubricator 18 and a pressure regulator 20 are also provided.

A suitable filtering component 22 may also be interposed between the pump 12 and a conventional fluid pressure regulator 24 for regulating the pressure of the glue supplied from the tank 10 by the pump 12. This pressure regulator 24 feeds an inlet 26 of a solenoid operated valve 28. This valve 28 is opened and closed in accordance with electrical control signals from a control apparatus or controller 30 fed thereto over a suitable cable 32. In response to control signals received from the controller 30, the solenoid operated valve 28 alternatively delivers or shuts off a flow of glue to a nozzle 34. In accordance with conventional non-contact gluing practice this nozzle 34, and in particular the outlet 35 thereof, is spaced apart a preselected distance 36 from the surface of a workpiece 38 to which glue is to be applied. In the illustrated embodiment this workpiece 38 comprises a folding carton.

This workpiece or carton 38 is carried in a direction 40 by a conventional conveyor 42 which carries a plurality of such cartons in spaced apart sequence thereon so as to sequentially apply glue to the upper surfaces thereof from the nozzle 34 in a predetermined, controlled pattern. The control system 30, as will be seen later, is suitable coordinated with the motion of the cartons 38 along the conveyor 42 relative to the nozzle 34 for opening and closing the valve 28 at the proper intervals to apply the desired patterns.

As disclosed in the copending application of James E. DeCamp et. al., Ser. No. 332,947, filed Dec. 21, 1981, now U.S. Pat. No. 4,408,562, a novel anti-tailing structure 43 is provided which cooperates with the glue nozzle 34 for substantially preventing trailing of glue upon the cartons 38, etc., subsequent to the valve 28 terminating the supply of glue to the nozzle 34. In the embodiment illustrated in FIG. 1, this novel antitailing structure 43 includes a further orifice or nozzle 44 mounted adjacent to the glue delivery nozzle 34. In the illustrated embodiment, this nozzle 44 is mounted to the structure including the glue nozzle 34 and valve 28 by means of a suitable bracket 46. The nozzle 44 delivers a stream of pressurized air at an appropriate time following the closing of the valve 28 so as to prevent tailing of the glue stream delivered at the nozzle 34 after shut-off of the valve 28. In this regard, the air nozzle 44 is delivered a supply of pressurized air in a controlled fashion by way of a second solenoid operated valve 48. In the illustrated embodiment, pressurized air is fed to the valve 48 from the air inlet 14 and filter 16 by way of a regulator 45 and a lubricator 47. The valve 48 is in turn opened and closed in a controlled fashion by the controller 30, which feeds suitable signals to the valve 48 by way of a cable 50.

In operation, the nozzle 34 delivers a stream or bead of glue from its outlet 35 to the surface of the carton 38 spaced a distance 36 therebelow. After the valve 28 has shut off, a remaining quantity of glue remains in this space 36, as well as in a portion of the nozzle 34 below the valve 28. This additional quantity of glue is thus no longer propelled by the pressure system described above, due to the shutting off of the valve 28. However, the substrate or carton 38 is still being propelled at a substantial speed in a direction 40 by the conveyor 42.

It is believed that it is the continued velocity in the direction 40 of the carton 38 which tends to draw the retaining glue portion out into an undesirable "tail". That is, since the acceleration imparted to this remaining glue portion rapidly decreases toward zero upon closing of the valve 28, the moving carton 38 in effect draws out the remaining quantity of glue in this fashion. It will be appreciated that as the speed of the conveyor 42 increases, this effect becomes more pronounced. The provision of the anti-tailing apparatus described above substantially eliminates this effect.

Figure 2A:
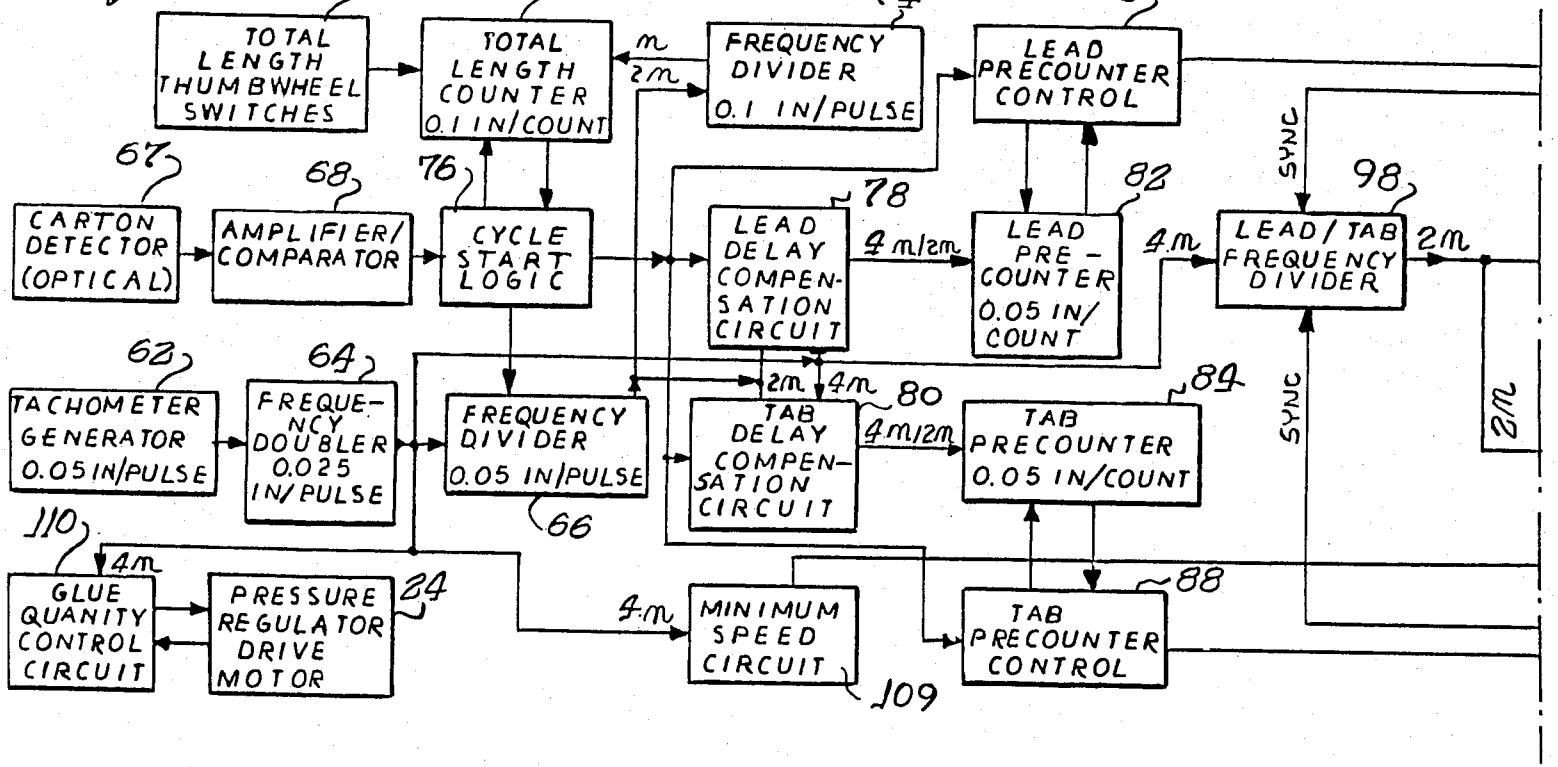
FIGS. 2A and 2B together form a block diagram of a portion of a control system with which the improvement of the invention is advantageously utilized.
Figure 2B:
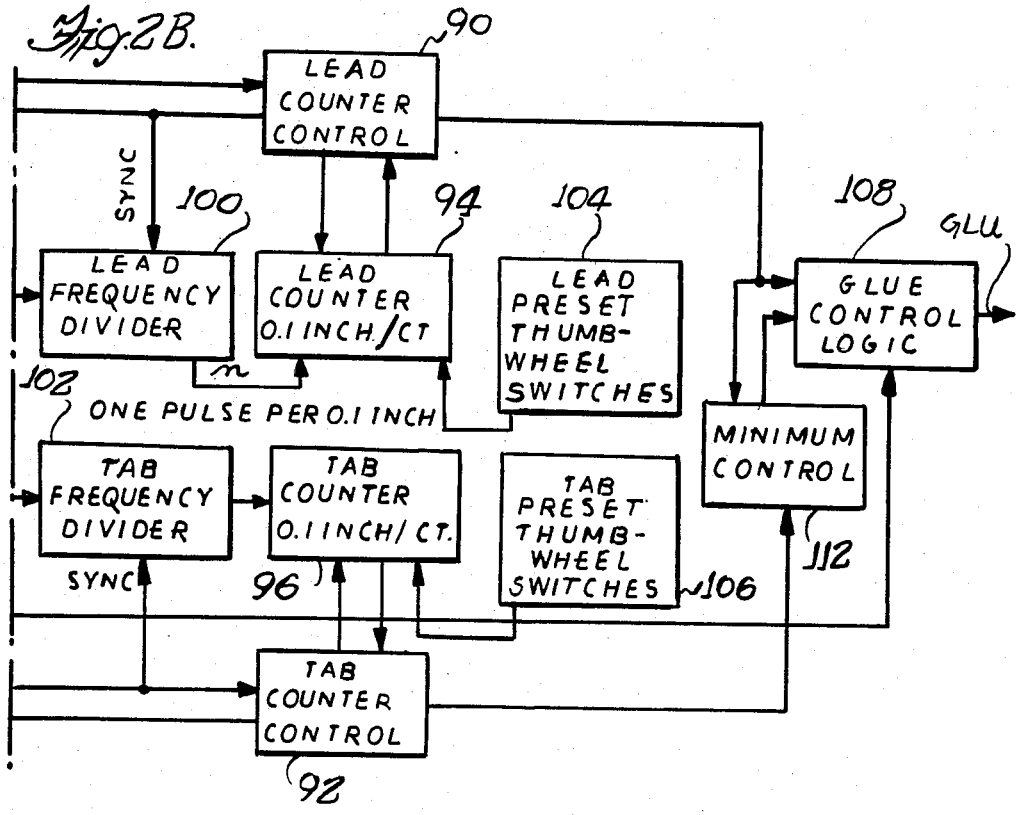

Referring now to FIGS. 2A and 2B a portion of the controller 30 for controlling the glue valve 28 is shown in block diagrammatic form.

In accordance with conventional practice, the conveyor 42 is provided with a speed transducer or tachometer generator 62, preferably in the form of a rotating body (not shown) frictionally engaged with the conveyor 42. This speed transducer delivers a series of pulse signals at a repetition rate correlative with the speed of the conveyor 42. The pulses from this tachometer generator 62 are fed into a frequency doubler stage 64 whose output is in turn fed into a frequency divider stage 66, the operation of which will be presently discussed.

Also in accordance with conventional practice a carton edge detector or sensor 67 (not shown in FIG. 1) is also provided spaced somewhat ahead (to the left in FIG. 1) of the glue delivery nozzle 34. Preferably, this carton edge detector takes the form of a photoelectric sensor (not shown). The output of the carton edge detector 67 feeds an amplifier/comparator stage 68 which compares the signal level from the photoelectric sensor with some reference point to ensure response thereof only to the passage of a leading carton edge into alignment therewith.

As a verification of the response of the carton edge detector, the total length of each of the cartons 38 carried on the conveyor 42 is set in as a suitable electric signal by way of an operator-accessible control 70. In this regard, it will be recognized that all of the cartons 38 carried on the conveyor 42 will be of substantially the same length in a single run. This total length control feeds a total length counter 72 which in turn receives input pulses from a further frequency divider 74, which is fed from the frequency divider 66, and from the carton edge detector by way of the amplifier/comparator 68 and cycle start logic circuitry 76. In this way, the total length counter 72 and associated cycle start logic 76 recognize and discard any false triggering of the carton edge detector 67. That is, should the carton edge detector be falsely triggered a second time before the conveyor 42 has moved a distance at least as great as the length of a carton 38, this second edge detection signal will be rejected. This may occasionally occur in cartons that have cut-outs or the like along their length.

In order to compensate for the electrical and mechanical delays inherent in opening of the solenoid operated glue valve 28 and in passage of the glue bead through the nozzle 34 and across the gap or space 36, a lead (start) delay compensation circuit 78 is utilized. This circuit 78 receives the divided frequency pulses from the divider 66 and the doubled frequency pulses from the frequency doubler 64 and provides a suitable signal to facilitate opening the valve 28 somewhat earlier to compensate for this delay. In similar fashion, a tab (stop) delay compensation circuit 80 receives the same signals from the frequency doubler 64 and frequency divider 66. This tab delay compensation circuit provides a similar compensation function for the closing of the valve 28, which it will be recognized also involves a similar time delay before closing of the valve 28 and cutoff of the glue bead in the nozzle 34 and space 36. It will be recognized that the greater the velocity of the conveyor 42 and hence carton 38, the greater the compensation which must be provided for the relatively fixed delay times involved in operation of the valve 28 in the travel of glue therefrom, across the distance space 36, to the surface of the carton 38.

In this regard, the pulses received from the tachometer generator 62 by way of the frequency doubler 64, frequency divider 66 and respective compensation circuits 78, 80 are counted by a pair of precounter circuits 82, 84. In principle, these circuits count simultaneously. However,, the delays are compensated for by feeding pulses at the rate of the frequency doubler to each of these counters for a time interval sufficient to accumulate a count which represents the movement of the conveyor 42 a distance corresponding to the respective delay times for both opening and closing of the valve 28. Hence, an increased count, to compensate for these delay times, is fed into the precounters 82 and 84 during the time the leading edge of the carton 38 travels from the carton edge detector or sensor 66 to the glue valve 34.

Each of the lead and tab precounters 82 and 84 has a predetermined maximum count in this regard, selected so that the leading edge of the carton 38 will just come in registry with the orifice 35 of the glue nozzle 34 when this maximum count is reached. However, the foregoing compensation arrangement results in this maximum count occurring somewhat earlier than this. Thereupon, corresponding lead and tab precounter control units 86 and 88 will signal corresponding lead and tab counter control units 90, 92. In response to this signal these lead and tab counter control units 90 and 92 will signal associated lead and tab counter units 94 and 96 to begin receiving the tachometer generator pulses by way of a suitable series of frequency dividers 98, 100 and 102. At this point the delay compensation is automatically carried over to these counters 94, 96.

The operator sets one or more desired points at which glue beads are to be respectively started and ended with respect to the leading edge of carton 38 by using corresponding lead (start) and tab (stop) preset controls 104, 106. The lead and tab counter and counter control units 90, 92 and 94, 96 then function to compare the starting and stopping points selected by the controls 104, 106 with their respectives accumulating (and delay compensated) counts. When the count in the lead counter reaches the point set for the beginning of a glue bead in the lead preset control 104, a corresponding glue control logic signal (GLU) is fed out by way of a glue logic control unit 108. Correspondingly, when the preselected ending point of a given glue bead has been reached, the tab counter control 92 outputs a corresponding logic signal. In normal operation, that is when the minimum glue bead control 112 is not selected, the output of the latter circuit 92 is fed directly to the glue control logic 108 to cause a corresponding logic signal to be produced thereby.

In the illustrated embodiment, this glue control logic signal (GLU) goes to a high or logic 1 state for the starting point or, more correctly, valve turn-on point for each glue bead to be delivered to the carton 38 and changes state to a low or logic 0 state for the end of each glue bead, or more correctly, the release of the valve 34 which is spring loaded to close and thereby end the glue bead.

A minimum speed detector circuit 109 may also be provided to shut down the glue control valve 34 by way of the control logic 108 should the conveyor speed fall before some predetermined minimum speed, for example, should a malfunction occur in the conveyor. Similarly, the tachometer generator pulses are also used to control the glue pressure regulator 24 by way of a suitable glue quantity control interface circuit 110. In this regard, it will be recognized that glue pressure must be advanced somewhat with increasing speeds of the conveyor 42 or conversely, retarded somewhat with decreasing speeds in order to apply substantially the same quantity of glue per unit distanced traveled by the carton 38.

Figure 3:
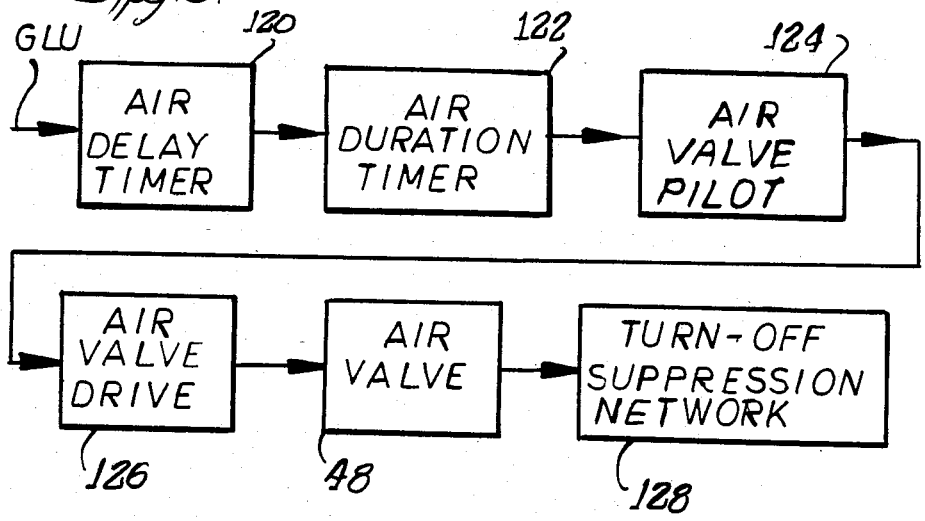
FIG. 3 is a block diagram of an additional portion of a control system useful with the apparatus of FIG. 1.

Referring now to FIG. 3 the air valve control circuit is shown in block diagrammatic form. The glue control signal (GLU) is fed into an air delay timer circuit 120. Specifically, the delay timer 120 responds to the falling edge of this control signal, that is, the transition thereof from the "glue on" or high logic state to the "glue off" or low logic state, for interposing a further time delay before initiating the air jet or stream of pressurized air at the nozzle 44 by actuating the valve 48 to an "open" condition. This delay is selected to compensate for the time delay in the operation of the glue valve 28, as discussed above, as well as for a similar time delay inherent in the operation of the air valve 48.

In this regard, the timing of the initiation of the air jet from the nozzle 44 relative to closing the glue valve should be such that the air jet will impinge upon the remainder of the glue stream in the gap or space 36, rather than upon the pattern or bead which has just been deposited. Hence, the air jet must be delayed the proper time to compensate for closing of the valve 28. On the other hand, the air jet must be initiated before a tail has begun to form on the carton 38. Accordingly, the air delay timer 120 is set to initiate the air jet from the orifice or nozzle 44 at the proper time in this regard.

The air delay timer 120 also feeds a starting signal to an air duration timer 122 which is set for the desired duration of the air jet from the orifice or nozzle 44. The duration of the air jet should of course be sufficiently long to complete the proper deposit of the remaining glue substantially within the desired glue bead or pattern so as to avoid tailing. However, the duration may be set somewhat higher than the expected time for this to occur in order to assure substantial elimination of any tailing. Beyond this limitation, the duration need only be adjusted to assure that the air jet will be off when the initiation of the next glue bead begins, and this is indicated by the glue control signal (GLU) going high at the input to a delay timer 120, which will automatically reset both the air delay timer 120 and air duration timer 122. The air duration timer 122 in effect passes the "valve open" signal produced by the air delay timer 120 as well as the delayed "valve close" signal to a suitable air valve pilot circuit 124 which in turn actuates an air valve driver circuit 126. This latter air valve drive circuit 126 supplies a suitable voltage and current, stepped up from the logic levels of the preceding circuitry, to the air valve 48. Preferably, a suitable turn-off suppression network 128 is also provided for suppressing voltage transients in the highly inductive solenoid coil utilized to operate the air valve 48.

In operation, the timers 120 and 122 are adjustable to permit accurate setting of the initiation of the energization of the air valve 48 and the duration of opening thereof. This permits accurate timing of the beginning and duration of the pressurized air stream or air jet 60 in relation to the cut-off of the glue valve 28, compensating for the delays in the respective components associated with both the glue valve 28 and air valve 48, so as to substantially eliminate trailing of the glue bead as described above. In the illustrated embodiment the pressurized air stream or air jet 60 is delivered at a pressure of from substantially 1.5 psi to 5 psi.

Figures 4, 5:
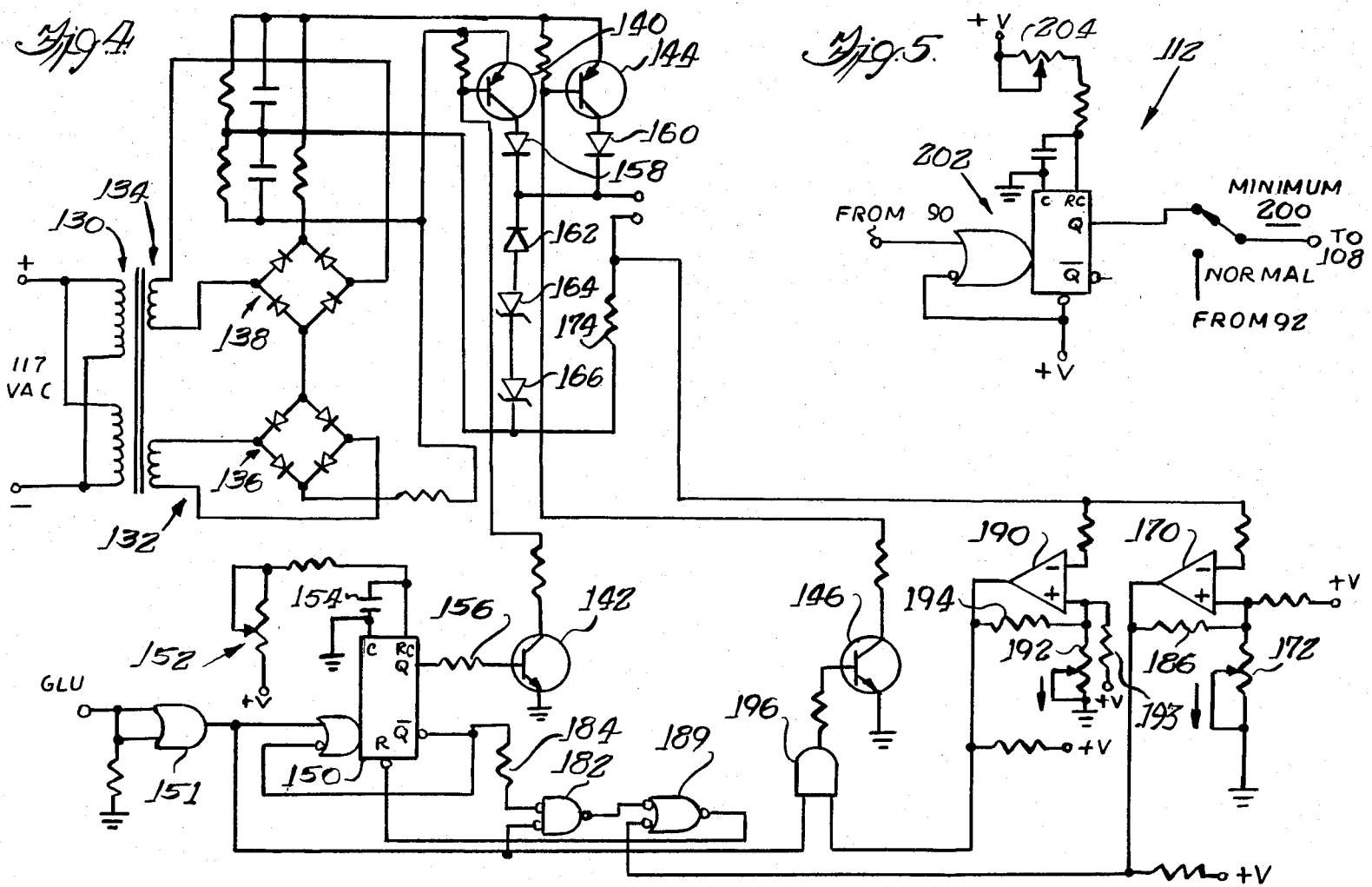
FIG. 4 is a circuit schematic diagram illustrating a further part of the control system of FIGS. 2A and 2B.
FIG. 5 is a circuit schematic diagram illustrating details of the improvement of the invention.

Reference is now invited to FIG. 4, wherein details of a driver circuit for energizing the glue valve 28 to its opened and closed state in response to the glue control signal (GLU) from the glue control logic 108 is illustrated. This circuit utilizes a pair of DC voltages, derived from a 117 volt AC line. Briefly, a conventional transformer 130 has a high voltage secondary 132 and a low voltage secondary 134. In the illustrated embodiment the high voltage secondary 132 is on the order of 50 volts and the low voltage secondary 134 is on the order of 10 volts. A pair of conventional full wave rectifier circuits 136 and 138 with suitable smoothing capacitors are provided for the 50 volt and 10 volt circuits, respectively. The 50 volts DC is fed through a power transistor 140 under the control of a pilot transistor 142 for initially energizing the valve 28 toward its open position. Similarly, the 10-volt DC power is fed by way of a power transistor 144 under the control of a pilot transistor 146 for holding the valve in the open position.

In operation, fairly rapid valve opening is achieved by initially applying 50 volts to the valve 28, which is preferably a 24-volt valve, for a short interval of on the order of 4 to 6 milliseconds. Hence, the normal valve opening time of on the order of 20 milliseconds is typically shortened to on the order of 4 to 5 milliseconds. However, a low voltage must be applied thereafter to avoid overheating of the valve while retaining it in the open condition. In this regard, a voltage of on the order of 10 volts DC is just sufficient to hold the valve open reliably, while reducing the demand upon the power supply. Additionally, the reduced holding voltage facilitates a more rapid valve closure.

To control the timing of the initial 50-volt DC application, a monostable 150 is provided which receives the glue control signal (GLU) by way of a suitable buffer 151. This monostable 150 produces a output pulse of a width determined by the RC value of a potentiometer 152 and a capacitor 154. The potentiometer 152 is preferably set to achieve a pulse width at the Q output of the monostable 150 of on the order of 4 to 6 milliseconds. In operation, the monostable 150 is triggered by the rising edge of the "glue on" signal (GLU) and generates at its Q output a pulse of 4 to 6 miliseconds in duration. This pulse is applied to the base of the pilot transistor 142 which turns on the power transistor 140 to apply the 50 volts DC to the valve 28 through a diode 158.

The "glue on" or logic one state of the GLU signal also turns on the pilot transistor 146 which is coupled to be driven from the output of the buffer 151. Hence, the pilot transistor 146 turns on the power transistor 144 to deliver 10 volts DC to the valve by way of a diode 160. However, since the cathode of this diode 160 is at substantially 50 volts DC due to the turning on of the 50-volt power transistor 140, the diode 160 does not conduct.

When the monostable 150 has timed out, the pilot transistor 142 goes off and hence the power transistor 140 is turned off. As soon as the high voltage at the cathode of diode 160 has dropped sufficiently, 10 volts DC will be applied to the valve 28. The circuit will remain in this condition as long as the glue command signal (GLU) remains in the logic one or high state. When the glue command signal goes low or to the logic zero state, the valve 28 is to be shut off to end the glue bead. Accordingly, the pilot transistor 146 and power transistor 144 are shut off. However, since the valve is solenoid operated, the highly inductive solenoid coil to which the foregoing 50-volt and 10-volt DC voltages are applied will tend to create a large negative voltage spike when either of the two driver transistors 140 or 144 is switched off.

Accordingly, a suppression network is provided which includes a first diode 162 and a pair of zener diodes 164, 166. The diode 162 has its cathode coupled to the cathodes of both diodes 158 and 160 and its anode in series with the anode of the zener diode 164. The cathode of this zener diode 164 is coupled to the anode of the zener diode 166 whose cathode is coupled with circuit ground. This circuit dissipates the stored energy of the valve solenoid coil when either of the 50-volt DC or 10-volt DC supplies are switched off much more rapidly than the conventional single diode coupled across the coil which is often utilized for such negative voltage suppression. This permits a correspondingly more rapid closure of the valve 28. In the illustrated embodiment, the two zener diodes 164 and 166 allow the coil voltage to fall to a negative 40-volt level with respect to ground. This additional fixed voltage drop in the path of circulating current greatly increases the initial rate of energy dissipation. Moreover, since this voltage drop remains relatively constant as long as there is any current flow, the dissipation does not fall off as rapidly with decreasing current as it does when a single diode is utilized for suppression. Additionally, when the circulating current falls to the point of which the inductive e.m.f. is lower than the zener voltage, the zener diodes 164, 166 stop conducting entirely and the current immediately falls to zero. Hence, the introduction of the zener diodes 164, 166 results in a network wherein the current decay is on the order of 1 to 2 milliseconds with a well-defined end point. The diode 162 prevents the zener diodes 164, 166 from diverting the drive current when the valve is energized.

An additional high current cutoff feature is provided by a comparator 170 which receives a reference voltage at its non-inverting input, set by a suitable potentiometer 172. The inverting input of this comparator 170 responds to the current flowing through the coil of the valve 28, by sensing the voltage across a resistor 174 coupled in series with the ground return line from this coil. In operation, when the 50-volt DC opening potential is applied by the transistor 140, at some critical value of current in the coil, the force acting upon the valve will be sufficient to open the valve. When this has occurred, the high voltage may be removed from the coil, even if the monostable 150 has not timed out. Accordingly, the comparator 170 and associated components terminate the high voltage drive from the power transistor 140 when the current through the coil of the valve 28 has reached a predetermined value. In the illustrated embodiment, this coil current value for tripping the comparator is set about 25% higher than the current actually required to open the valve. Accordingly, the potentiometer 172 is set to establish a reference voltage substantially similar to the voltage on resistor 174 when this coil current is reached. The output of the comparator 170 feeds one input of a two-input NOR gate 180, whose output feeds the reset input of the monostable 150. The second input of this NOR gate 180 is fed from the output of a two-input NAND gate 182, which receives one input from the output of the buffer 151 and its second input from the $\overline{Q}$ output of the monostable 150 by way of a suitable resistor 184.

Additionally, the comparator 170 is provided with positive feedback by a resistor 186 so that once the comparator is tripped by the coil current reaching the preset limit, it will remain tripped until the coil current drops to a lower value. The value of the current at which the comparator 170 will recover is well below that supplied during the application of the 10-volt holding voltage to the coil of the valve 28. Hence, retriggering of the 50-volt source is prevented until the valve is shut off and current through the valve coil has fallen substantially to zero.

In order to facilitate a more rapid transition between the 50-volt opening voltage and 10-volt holding voltage, an additional low voltage hold off circuit is provided including a second comparator 190. This comparator 190 also responds to the current flowing through the coil by sampling the voltage at the resistor 174. The associated circuit components include a potentiometer 192 and feedback resistor 194. Hence, the comparator 190 operates in similar fashion to the comparator 170. However, the voltage selected by potentiometer 192 is set to trip the comparator 190 during the initial high voltage (50 volts DC) pulse to the valve coil from the power transistor 140. The output of this second comparator 190 feeds one input of a two-input AND gate 196 whose output feeds the base electrode of the low voltage pilot transistor 146. The remaining input of the gate 196 receives the glue control signal (GLU) from the output of the buffer 151. Hence, the low voltage pilot transistor 146 and responsive low voltage (10-volt DC) power transistor 144 cannot be turned on to deliver the 10-volt holding voltage to the coil until the comparator 190 recovers. This recovery level is set by potentiometer 192, bias resistor 193 and positive feedback resistor 194, such that the current sensed at the resistor 174 must fall well below the initial threshold before the comparator re-enables the gate 196.

In operation, when the high voltage pulse (50 volts) ends, the low voltage pilot 146 is still blocked at the gate 196 by the action of the comparator 190. Accordingly, as discussed above, the energy in the coil is rapidly dissipated by the network including the zener diodes 164 and 166, so that the current in the coil falls very rapidly. When this current reaches the trigger level of the comparator 190 its output again goes high re-enabling the gate 196 and hence the low voltage (10-volt DC) application by way of the pilot transistor 146 and power transistor 144. In this fashion, the transition from the high voltage drive to the low voltage drive on the coil is completed in one or two milliseconds, rather than something on the order of 20 or 30 milliseconds which would be required without the low voltage hold off and reverse e.m.f. dissipation features.

The foregoing drive circuit to the valve 28 normally operates to substantially fully open and fully close the valve, as required for reliable glue release, in response to the high (logic one) and low (logic zero) states of the glue control signal (GLU), respectively. However, it will be remembered that the glue control signal is generated in response to the position of the carton, so as to open and close the valve (with delay compensation as discussed above) at proper times to deposit glue beads at the desired starting and ending points on the carton. As mentioned above, in practice there is a minimum time required to achieve valve cycling as well as a potential one count (plus or minus) error in the counting system.

Hence, it has been found that the minimum length of glue bead which can be deposited on a carton is limited by these system constraints. Moreover, since the foregoing circuits normally operate in response to carton position only, the minimum amount of time required for valve opening may not be met for short beads if conveyor speed increases.

It has been found that the minimum length glue bead which may be deposited with the above-described apparatus is substantially directly proportional to the conveyor speed, and is on the order of 1 inch to 1.4 inches at a 1,000 foot per second conveyor speed. While the tab counter control 92 may be set to give a glue bead of shorter length, because of the minimum time constraint and possible plus or minus one count error therein, this often results in erratic operation or even failure to deposit a glue bead.

Referring now to FIG. 5, in accordance with the invention, the minimum glue bead control circuit 112 is substituted for the tab counter control 92 in instances when a glue bead shorter than the normally achievable minimum is desired. In this regard, a switch 200 is provided at the input of the glue control logic 108 for selecting the output of one of the tab counter control 92 or the minimum glue control circuit 112 for causing the transition of the glue control signal (GLU) to its off or logic zero state.

The minimum glue control circuit comprises a monostable multivibrator 202 which is substantially similar to the monostable multivibrator 150 described above. The monostable 202 receives its input from the lead counter control 90 which it will be remembered produces a signal for causing the glue control signal (GLU) to go to its "on" or logic one state for initiating the opening of the valve 28. A time delay for the Q output of the monostable 202 is established by an RC network including a suitable adjustable potentiometer 204. This Q output of the monostable 202 is selectable by the switch 200, in place of the tab counter control 92 to feed the glue control logic circuit 108. Accordingly, when the monostable 202 is selected by the switch 200, the total time duration of the "glue on" control signal (GLU high) is controlled by the setting of the potentiometer 204. This time is selected to assure provision of the minimum time necessary for proper valve cycling.

In practice, a suitable setting of the potentiometer 204 may be arrived at by observing the length of glue bead consistently deposited while adjusting the setting of the potentiometer 204 until the desired minimum length glue bead is achieved. In practice, the minimum control circuit has been found to reduce the minimum length glue bead which may be deposited by the apparatus of the invention by substantially one-half. Since this is a time-based control, the minimum glue bead achievable is dependent upon the speed of the conveyor. However, it has been found that at 1,000 feet per minute, a minimum glue bead of on the order of from substantially 0.5 to 0.7 inches can be achieved with the circuit 112 according to the invention.

It is believed that the controlled time interval between the logic one (on) and logic zero (off) states of the glue control signal (GLU) when the circuit 112 is selected causes the circuit of FIG. 4 and hence the valve 28 to operate more reliably than when under the control of the tab counter control 92. In this regard, the foregoing time interval is selected so that the valve is always driven to its fully open state by the circuit of FIG. 4. It will be appreciated that the valve closes by a return spring so that closure time remains more or less constant.

Accordingly, while the valve is opened sufficiently to release a reliable glue bead, it is not held opened any longer than this. This permits the valve to begin closing sooner and thereby produces a much shorter glue bead than may be reliably produced without the use of the minimum glue control circuit 112.

While the invention has been illustrated and described hereinabove with reference to preferred embodiments, the invention is not so limited. For example, while a non-contact gluing system has been described as a preferred embodiment, the invention is also useful with a contact system of the type wherein an extruding applicator rides on the surface of the substrate. Those skilled in the art may devise various alternatives, changes and modifications upon reading the foregoing. The invention includes such changes, alternatives and modifications insofar as they fall within the spirit and scope of the appended claims.

The invention is claimed as follows:

1. An improvement in a coating system including coating dispensing means having at least one coating outlet for delivering coating material to a surface of a moving workpiece to which coating is to be applied in a desired pattern, dispensing control means operatively coupled with said dispensing means and responsive to the position of said workpiece surface relative to a given fixed reference point for producing control signals for initiating and terminating the release of coating material to said outlet as predetermined portions of said workpiece surface come into alignment with said coating outlet, the improvement comprising: timing means responsive to said dispensing control means for producing a control signal for terminating said release of coating material a selectable time interval after initiation thereof in response to said dispensing control means; and means for selecting the control signal from one of said dispensing control means and said timing means for controlling each termination of said release of coating material.

2. The improvement according to claim 1 wherein said dispensing means includes at least one valve which is responsive to said dispensing control means for opening and closing to control said release of coating material to said at least one coating outlet, said valve having a characteristic minimum response time for fully closing following full opening thereof, said dispensing control means being normally operative for producing a valve open signal for fully opening the valve and a valve close signal to begin said closing of the valve; both the valve open and valve close signals being produced in accordance with the position of said workpiece surface relative to said given fixed reference point; and wherein said timing means is responsive to said valve open signal for producing a valve close signal after a preselected time interval, and wherein said selecting means is operative for selecting the valve close signal from one of said dispensing control means and said timing means.

3. The improvement according to claim 2 wherein said timing means further includes operator accessible control means for adjusting said preselected time interval for producing said valve close signal a predetermined minimum time after and in response to said valve open signal and thereby minimizing the time during which said valve is open so as to deliver a preselected minimum length of coating to said workpiece surface, said predetermined minimum length being substantially less than the minimum length which may be reliably achieved in response to said dispensing control means alone.

4. The improvement according to claim 3 wherein said timing control means comprising timing circuit means having active and inactive output states and responsive to said valve open signal for assuming said active output state and after said preselected time interval assuming said inactive output state.

5. The improvement according to claim 4 wherein said timing circuit means comprises at least one monostable multivibrator.

6. The improvement according to claim 1 wherein the coating comprises glue and the workpiece comprises a paper carton.

7. An improvement in apparatus for applying a coating to a surface of a moving workpiece including valve means having at least one outlet for dispensing coating material and valve control means operatively coupled with said valve means for controlling the opening and closing of said valve means in accordance with the position of said workpiece surface relative to said coating outlet, said valve control means normally operating to fully open said valve means and said valve means having a characteristic minimum response time for fully closing in response to said said valve control means following full opening thereof, said improvement comprising: timing means responsive to said valve control means for initiating a selectable time delay and immediately thereafter producing a control signal for initiating closing of said valve means, for substantially optimizing the operation of said valve means so as to deliver a selectable minimum length of coating to said workpiece surface which is substantially less than the minimum coating length normally achieveable in response to said valve control means along; operator accessible adjustment means for adjusting the length of the time delay produced by said timing means; and operator accessible selector means for selecting one of said valve control means and said timing means for initiating the closing of said valve means.

8. The improvement according to claim 7 wherein said timing means comprises at least one monostable multivibrator.

* * * * *